US009314394B2

(12) United States Patent
Hirata et al.

(10) Patent No.: US 9,314,394 B2
(45) Date of Patent: Apr. 19, 2016

(54) MOTION ASSISTING DEVICE, CONTROL METHOD THEREFOR, AND REHABILITATION METHOD

(75) Inventors: Takashi Hirata, Wako (JP); Kiyoshi Oikawa, Wako (JP); Masami Saito, Kawagoe (JP); Toshinobu Okaji, Kawagoe (JP); Yuki Araki, Kawagoe (JP)

(73) Assignee: HONDA MOTOR CO., LTD., Tokyo (JP)

( * ) Notice: Subject to any disclaimer, the term of this patent is extended or adjusted under 35 U.S.C. 154(b) by 883 days.

(21) Appl. No.: 13/502,541

(22) PCT Filed: Oct. 21, 2010

(86) PCT No.: PCT/JP2010/068604

§ 371 (c)(1),
(2), (4) Date: May 8, 2012

(87) PCT Pub. No.: WO2011/049171

PCT Pub. Date: Apr. 28, 2011

(65) Prior Publication Data

US 2012/0215140 A1 Aug. 23, 2012

Related U.S. Application Data

(60) Provisional application No. 61/253,643, filed on Oct. 21, 2009.

(51) Int. Cl.

| | |
|---|---|
| ***A61H 1/00*** | (2006.01) |
| ***A61H 3/00*** | (2006.01) |
| *A61H 1/02* | (2006.01) |

(52) U.S. Cl.

CPC ..... *A61H 3/00* (2013.01); *A61H 1/0244* (2013.01); *A61H 1/024* (2013.01); *A61H 2201/1215* (2013.01); *A61H 2201/165* (2013.01); *A61H 2201/5007* (2013.01); *A61H 2201/5035* (2013.01); *A61H 2201/5043* (2013.01); *A61H 2201/5048* (2013.01); *A61H 2201/5069* (2013.01); *A61H 2201/5092* (2013.01); *A61H 2230/625* (2013.01)

(58) Field of Classification Search

CPC ..... A61H 1/024; A61H 1/0244; A61H 3/00
USPC ..... 601/5, 23, 33, 34, 35; 602/5, 16, 19, 23, 602/24, 25, 26, 27

See application file for complete search history.

(56) References Cited

U.S. PATENT DOCUMENTS

2005/0177080 A1* 8/2005 Yasuhara et al. ..... 602/16
2006/0270951 A1* 11/2006 Ikeuchi ..... 601/5

(Continued)

FOREIGN PATENT DOCUMENTS

JP 2004-073649 3/2004
JP 2004-329520 11/2004

(Continued)

OTHER PUBLICATIONS

German Office Action and English Translation dated Jun. 25, 2013, 10 pages.

*Primary Examiner* — Quang D Thanh
(74) *Attorney, Agent, or Firm* — Rankin, Hill & Clark LLP

(57) ABSTRACT

A motion assisting device or the like, wherein the asymmetry degree of the motion patterns of human limbs is evaluated according to the variation patterns of the values of a pair of posture variables which vary with the postures in the respective same locations of the limbs. Furthermore, the evaluation result of the degree of the asymmetry can be utilized as the foundation of the motion control of the actuator of the motion assisting device. As a result, the motion of the human limbs can be assisted by the motion assisting device in such a manner that the balance of the motion patterns of the limbs is adjusted.

11 Claims, 9 Drawing Sheets

(56) References Cited

U.S. PATENT DOCUMENTS

| | | | | |
|---|---|---|---|---|
| 2009/0131839 | A1* | 5/2009 | Yasuhara | 601/5 |
| 2009/0312677 | A1* | 12/2009 | Ikeuchi | 601/34 |
| 2009/0312844 | A1* | 12/2009 | Ikeuchi et al. | 623/40 |

FOREIGN PATENT DOCUMENTS

| | | |
|---|---|---|
| JP | 2005-043644 | 2/2005 |
| JP | 2006-102156 | 4/2006 |

* cited by examiner

MOTION ASSISTING DEVICE, CONTROL METHOD THEREFOR, AND REHABILITATION METHOD

TECHNICAL FIELD

The present invention relates to a motion assisting device and the like configured to assist motions of a human limb.

BACKGROUND ART

Hitherto, there has been disclosed an education approach for educating a rehabilitation training technique by using a human body model to demonstrate motions of a joint such as a shoulder joint of an upper limb, a hip joint of a lower limb or the like (for example, refer to Patent Document 1)

CITATION LIST

Patent Documents

Patent document 1: Japanese Patent No. 3735672

SUMMARY OF INVENTION

Technical Problem

However, according to the approach, it is difficult to train a subject to have similar motions to a physically healthy person because the training is dependant on capabilities or the like of the subject under training.

The present invention has been accomplished in view of the aforementioned problems, and it is therefore an object of the present invention to provide a motion assisting device and the like capable of correcting the unbalance of motion patterns between a pair of human limbs.

Solution to Problem

The present invention relates to a motion assisting device provided with a pair of orthoses symmetrically mounted on a pair of limbs of a human being, respectively, and an actuator connected to each of the pair of orthoses, respectively, and configured to control a variation pattern of an assisting force transmitted from the actuator to the pair of limbs via the pair of orthoses, respectively; a control method therefor; and a rehabilitation method for rehabilitating motor functions of a pair of limbs of a human being by using the motion assisting device.

To attain an object described above, the control method for the motion assisting device of the present invention comprises a first step of detecting variation patterns of values of a pair of posture variables varying with the postures of the pair of limbs mounted with the pair of orthoses at the same location, respectively, and a second step of evaluating the asymmetry degree of motion patterns of the pair of limbs as the foundation of the motion control of the actuator according to the variation patterns of the values of the pair of posture variables (First aspect).

In the control method of the first aspect of the present invention, it is acceptable that at least one of the deviation between maximum values and the deviation between minimum values of each of the pair of posture variables is calculated as the asymmetry degree on the basis of the variation patterns of the values of the pair of posture variables, or the asymmetry degree is evaluated to become continuously or gradually higher as the deviation between the minimum values becomes greater on the basis of the variation patterns of the values of the pair of posture variables in the second step (Second aspect).

It is acceptable that the control method of the second aspect of the present invention further includes a third step of discriminating a gait form of the human being according to the evaluation result of the asymmetry degree (Third aspect).

In the control method of the third aspect of the present invention, it is acceptable that a first left asymmetry degree which is the deviation of a maximum value or an average value of the posture variables of the left limb from a maximum value or an average value of the posture variables of the right limb, a first right asymmetry degree which is the deviation of a maximum value or an average value of the posture variables of the right limb from a maximum value or an average value of the posture variables of the left limb, a second left asymmetry degree which is the deviation of a minimum value or an average value of the posture variables of the left limb from a minimum value or an average value of the posture variables of the right limb, and a second right asymmetry degree which is the deviation of a minimum value or an average value of the posture variables of the right limb from a minimum value or an average value of the posture variables of the left limb are calculated as the asymmetry degree in the second step, and the sufficiency of a first right symmetry condition that the first right asymmetry degree is not greater than a first threshold value, the sufficiency of a first left symmetry condition that the first left asymmetry degree is not greater than the first threshold value, the sufficiency of a second right symmetry condition that the second right asymmetry degree is not greater than a second threshold value, and the sufficiency of a second left symmetry condition that the second left asymmetry degree is not greater than the second threshold value are determined respectively in the third step, and the gait form of the human being is discriminated according to the different determination results (Fourth aspect).

In the control method of the fourth aspect of the present invention, it is acceptable that the gait form of the human being is discriminated as a first gait form in the third step if the determination result is that the first left symmetry condition and the second left symmetry condition among the four symmetry conditions are not satisfied or the first right symmetry condition and the second right symmetry condition among the four symmetry conditions are not satisfied (Fifth aspect).

In the control method of the fourth aspect of the present invention, it is acceptable that the gait form of the human being is discriminated as a second gait form in the third step if the determination result is that the first left symmetry condition and the second right symmetry condition among the four symmetry conditions are not satisfied or the first right symmetry condition and the second left symmetry condition among the four symmetry conditions are not satisfied (Sixth aspect).

In the control method of the fourth aspect of the present invention, it is acceptable that the gait form of the human being is discriminated as a third gait form in the third step if the determination result is that any one symmetry condition among the four symmetry conditions is not satisfied (Seventh aspect).

It is acceptable that the control method of the fourth aspect of the present invention further includes a fourth step of controlling motions of the actuator so as to make the four symmetry conditions satisfied respectively (Eighth aspect).

In the control method of the first aspect of the present invention, it is acceptable that a temporal variation pattern of inclined angles by a joint, which is located at the root of each of the pair of limbs to a main body, in the anteroposterior direction is detected as the temporal variation pattern of the values of the posture variables in the first step (Ninth aspect).

To attain an object described above, the controller in the motion assisting device of the present invention is configured to detect variation patterns of values of a pair of posture variables varying with the postures of the pair of limbs mounted with the pair of orthoses at the same location, respectively, and evaluate the asymmetry degree of motion patterns of the pair of limbs as the foundation of the motion control of the actuator according to the variation patterns of the values of the pair of posture variables (Tenth aspect).

The motion assisting device is a walk assisting device configured to assist the periodic motions of a thigh in each of a pair of legs serving as the pair of limbs in a walking motion of the human being, and the controller is configured to control the motions of the actuator to decrease the asymmetry degree (Eleventh aspect).

To attain an object described above, a walk assisting device is provided as the motion assisting device of the present invention. The walk assisting device is provided with a pair of orthoses symmetrically mounted on a pair of thighs of a human being, respectively, an actuator connected to each of the pair of orthoses, respectively, and a controller being configured to control a variation pattern of an assisting force transmitted from the actuator to the pair of thighs via the pair of orthoses, respectively, through controlling motions of the actuator, wherein the controller is configured to detect a hip joint angle which is defined to be negative when the thigh is posterior to the frontal plane and be positive when the thigh is anterior to the frontal plane, and control the motions of the actuator to decrease a difference between the amplitude of a left hip joint angle and the amplitude of a right hip joint angle depending on the distinction of a flexion state where the hip joint angle is increasing in a range smaller than a positive reference value, a stretch state where the hip joint angle is decreasing, or an upswing state where the hip joint angle is increasing in a range not smaller than the positive reference value, respectively (Twelfth aspect).

In the walk assisting device of the twelfth aspect of the present invention, it is acceptable that when a difference is present between motor function levels of a pair of legs of the human being, the controller is configured to control the motions of the actuator to increase the assisting force in the stretch state and decrease the assisting force in the flexion state and the upswing state for the leg having a higher motor function level, and meanwhile decrease the assisting force in the stretch state and increase the assisting force in the flexion state and the upswing state for the other leg having a lower motor function level in comparison with the case where the difference is absent (Thirteenth aspect).

In the walk assisting device of the twelfth aspect of the present invention, it is acceptable that when a difference is present between motor function levels of a pair of legs of the human being, the controller is configured to control the motions of the actuator to decrease the assisting force in the stretch state and the flexion state and increase the assisting force in the upswing state for the leg having a higher motor function level, and meanwhile increase the assisting force in the stretch state and the flexion state and decrease the assisting force in the upswing state for the other leg having a lower motor function level in comparison with the case where the difference is absent (Fourteenth aspect).

In the walk assisting device of the thirteenth aspect or the fourteenth aspect of the present invention, it is acceptable that the controller is configured to control the motions of the actuator to adjust the assisting force according to a map, a table or a relational expression denoting the relationship between the hip joint angle and the assisting force on the basis of the hip joint angles of the pair of hip joints of the human being (Fifteenth aspect).

To attain an object described above, the rehabilitation method of the present invention comprises: a first step of detecting variation patterns of values of a pair of posture variables varying with the postures of the pair of limbs mounted with the pair of orthoses at the same location, respectively, a second step of evaluating the asymmetry degree of motion patterns of the pair of limbs as the foundation of the motion control of the actuator according to the variation patterns of the values of the pair of posture variables, a third step of discriminating a gait form of the human being according to the evaluation result of the asymmetry degree, and a fourth step of determining a control pattern of the motions of the actuator according to the gait form of the human being (Sixteenth aspect).

Advantageous Effects of Invention

According to the motion assisting device and the like of the present invention, the asymmetry degree of the motion patterns of the pair of limbs of a human being is evaluated according to the variation patterns of the values of a pair of posture variables which vary with the postures in the respective same locations of the limbs. Furthermore, the evaluation result of the asymmetry degree can be utilized as the foundation of the motion control of the actuator of the motion assisting device.

As a result, the motion of the pair of limbs of the human being can be assisted by the motion assisting device in such a manner that the balance of the motion patterns of the pair of limbs is adjusted. For example, when either side of a pair of legs of a human being is paralyzed or the like to cause a difference between motor function levels of the pair of legs, the motions of the pair of legs of the human being can be assisted so as to reduce or eliminate the difference, or to reduce or eliminate the asymmetry degree of the motion patterns of the pair of legs. Therefore, such rehabilitation effects as correcting the deformation of the body of the human being, reducing or eliminating the unbalance of the motor functions between the pair of limbs can be expected.

MODE FOR CARRYING OUT THE INVENTION

Hereinafter, symbols "L" and "R" are used to differentiate a left limb and a right limb or the like, respectively. However, the symbols may be omitted if there is no need to differentiate a left part and a right part or a vector having both of left and right components mentioned. Moreover, symbols "+" and "−" are used to differentiate a flexion motion (forward motion) and a stretch motion (backward motion) of a leg (in particular, a thigh) with respect to an upper body of a human being.

(Configuration of Motion Assisting Device)

Figure 1:
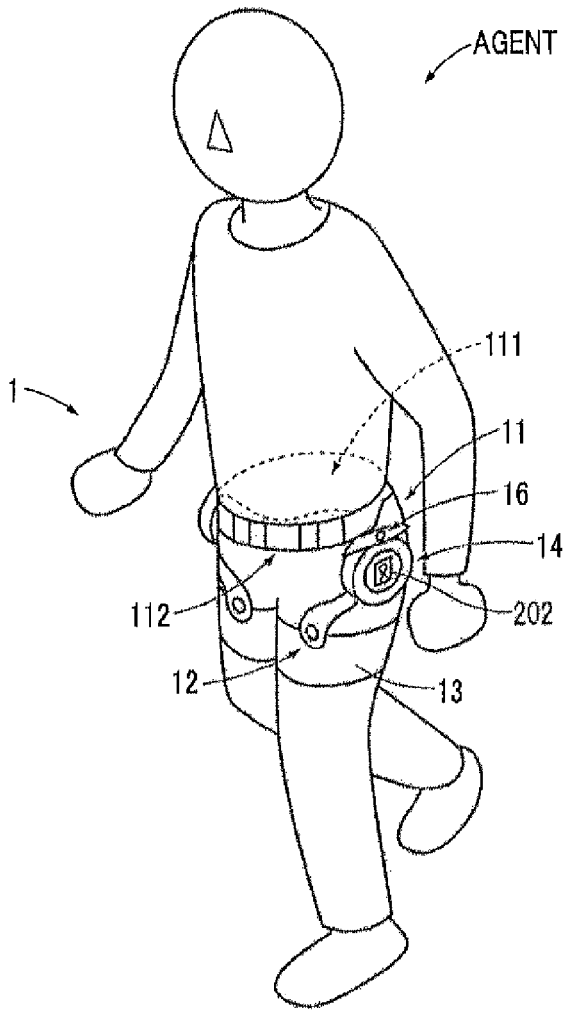
FIG. 1 is a configuration diagram of a motion assisting device according to an embodiment of the present invention.
Figure 2:
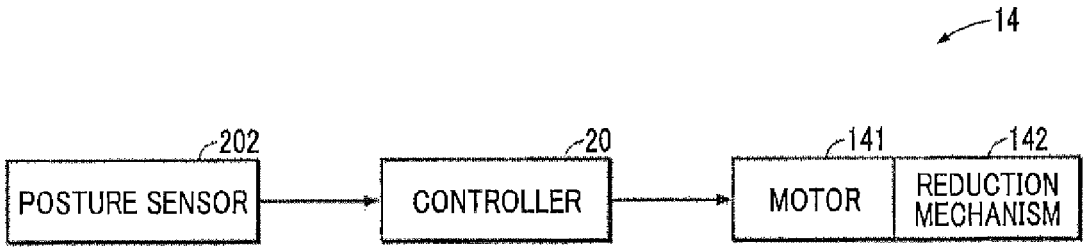
FIG. 2 is a configuration diagram of a controller provided in the motion assisting device.

The motion assisting device 1 illustrated in FIG. 1 is a walk assisting device provided with a first orthosis 11, a second orthosis 12, an actuator 14 and an audio outputting unit 16. As illustrated in FIG. 2, the motion assisting device 1 is also provided with a posture sensor 202 and a controller 20.

The first orthosis 11 is provided with a waist supporter 111 configured to be pressed against the waist of an agent (a human being as an agent) from the backward and a band 112 configured to be wrapped around the abdomen for fixing the waist supporter at the waist. The waist supporter 111 is made from, for example, rigid resin having appropriate hardness and flexibility. Each lower end portion of the waist supporter 111 at both lateral sides is mounted with the actuator 14 having a degree of freedom of rotation around the roll axis.

The second orthosis 12 is composed of a band configured to be wrapped around the thigh of a leg of the agent. A link member 13 for transmitting an output from the actuator 14 to the second orthosis 12 is mounted on the second orthosis 12 at the front side of the thigh and is configured to have a degree of freedom of rotation around the roll axis. The link member 13 is made from rigid resin and is shaped to curve from both lateral sides of the waist of the agent toward the front side of both thighs, respectively.

The configuration of the second orthosis 12 and the link member 13 may be altered arbitrarily if the output from the actuator 14 can be transmitted to the thigh via the second orthosis 12 and the link member 13. For example, it is acceptable to adopt the configuration disclosed in Japan Patent No. 4008464.

The controller 20 is composed of a computer (having a CPU, a ROM, a RAM, an I/O circuit, an A/D conversion circuit and the like) housed in the waist supporter 111 of the first orthosis 11. The controller 20 is configured to perform an arithmetic process on the basis of the output signals from the posture sensor 202 according to a software retrieved from an appropriate memory so as to control the motions of the actuator 14.

The controller 20 is configured or programmed to control the motions of the actuator 14 so as to match a maximum value $\Phi max$ and a minimum value $\Phi min$ of a posture variable with a desired maximum value $\Phi max_des$ and a desired minimum value $\Phi min_des$ thereof, respectively. Therefore, besides that the controller 20 is configured to perform a feedback control with the posture variable $\Phi$ served as a control variable, it is also acceptable to adopt the configuration disclosed in Japan Patent No. 4008464 or 4008465 possessed by the applicants of the present invention as the configuration of the controller 20.

The desired maximum value $\Phi max_des$ and the desired minimum value $\Phi min_des$ of the posture variable $\Phi$ are defined respectively not to deviate from an allowable range set in consideration of a normal motion state of the agent.

The actuator 14 is provided with a motor 141 and a reduction mechanism 142. The motions of the motor 141 and a reduction ratio of the reduction mechanism 142 are controlled by the controller 20, respectively. The output from the motor 141 after being processed by the reduction mechanism 142 is equivalent to the output from the actuator 14. While the output from the actuator 14 is being transmitted via the first orthosis 11 to the waist of the agent, it is transmitted via the link member 13 and the second orthosis 12 to the legs (specifically the thighs) of the agent as well.

Figure 3:
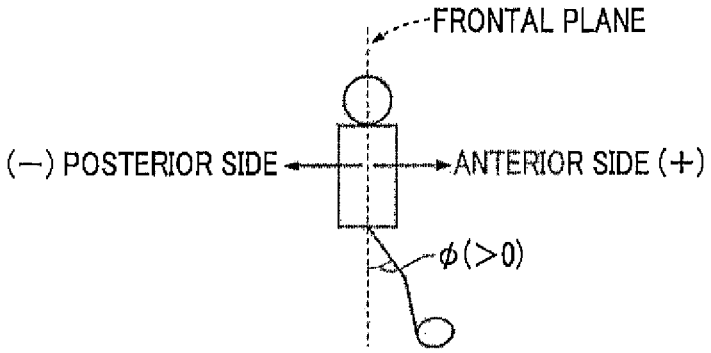
FIG. 3 is an explanatory diagram related to posture variables.
Figure 3:
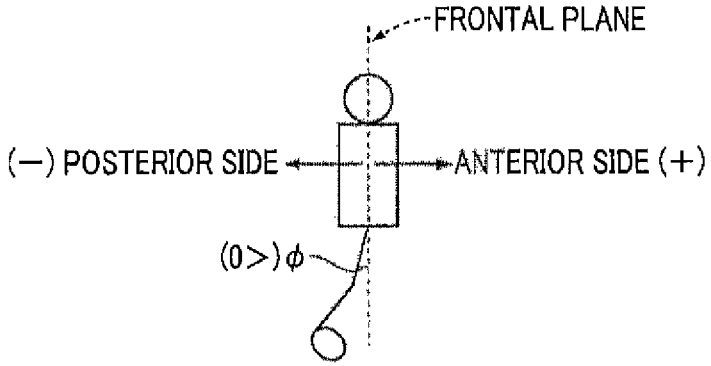

The posture sensor 202 is configured to output signals corresponding to values of a pair of posture variables varying with the postures of a pair of lower limbs or thighs mounted with the second orthoses 12 at the same location, respectively. For example, relative angles $\Phi$ of the pair of thighs to the waist of the agent respectively (hereinafter, referred to as the hip joint angle) are used as a pair of posture variables. The hip joint angle $\Phi$ is defined positive when the thigh is anterior to the frontal plane (a plane which divides the upper body in the anteroposterior direction and tilts with the anteroposterior tilting of the upper body) (at the flexion side) as illustrated by FIG. 3(*a*) and negative when the thigh is posterior to the frontal plane (at the stretch side) as illustrated by FIG. 3(*b*).

A rotary encoder which is configured to output signals according to leaning angles of the link member 13 in the anteroposterior direction or a hall element which is configured to output signals according to rotary angles of the motor included in the actuator 14 may be adopted as the posture sensor 202. In addition, it is acceptable to determine the posture variables by analyzing images captured by an imaging device which captures a moving human being with time; it is also acceptable to determine the posture variables via an optical motion capture system or the like.

(Control Method for Motion Assisting Device and Rehabilitation Method)

Immediately after the initiation of the motion assisting device 1, all flags denoting the asymmetry degree which will be described hereinafter are initialized to "0". A series of procedures to be described later may be performed every one walking cycle of the agent or may be performed in several walking cycles thereof.

Figure 4:
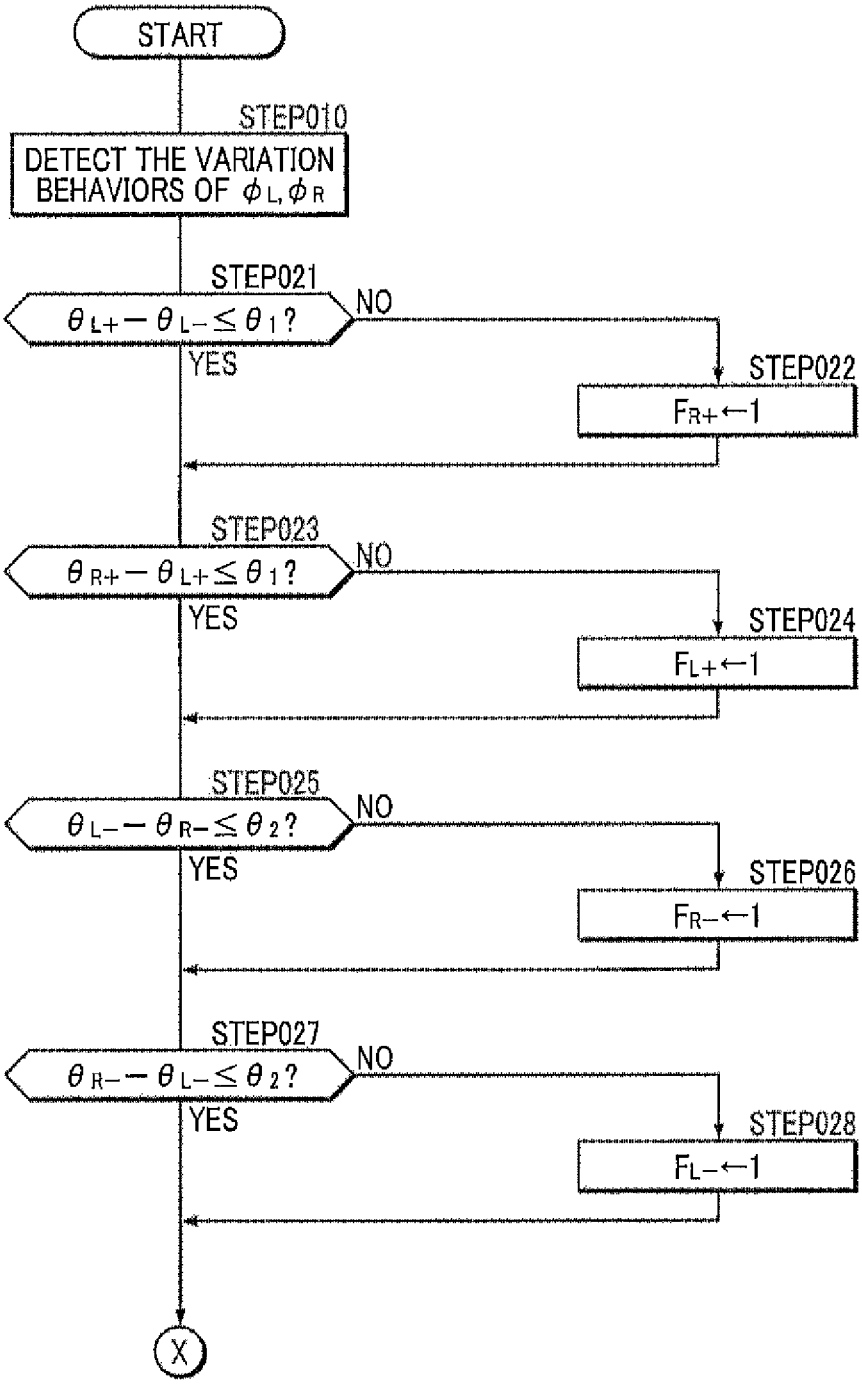
FIG. 4 is an explanatory diagram related to a control method and a rehabilitation method of the motion assisting device (Part 1)

In this state, firstly, a first step is performed to detect variation patterns of values of a pair of posture variables varying with the postures of the pair of lower limbs at the same location, respectively. Specifically, when the agent is in a walking or a running motion, the variation patterns of the right and left hip joint angles $\Phi R$ and $\Phi L$ are detected according to the output signals from the posture sensor 202 (FIG. 4/STEP 010).

Figure 6:
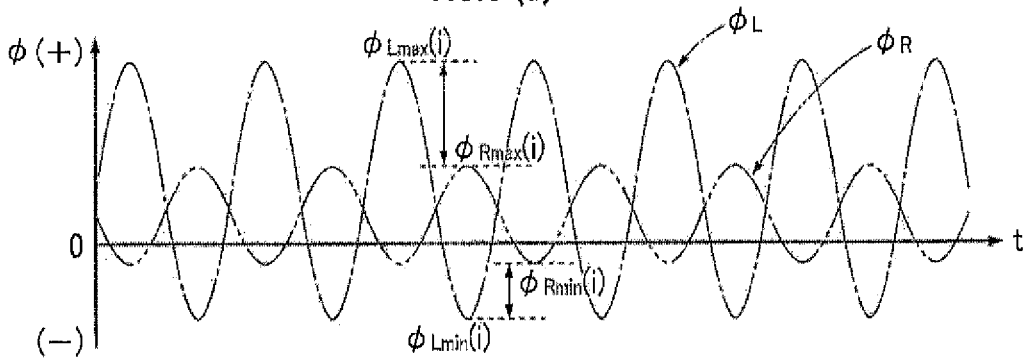
FIG. 6 is an explanatory diagram related to variation patterns of the posture variables according to gait forms.
Figure 6:
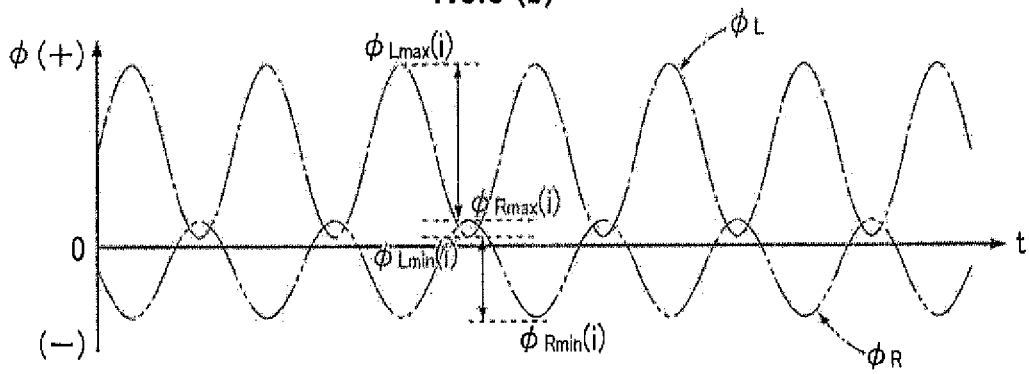
Figure 6:
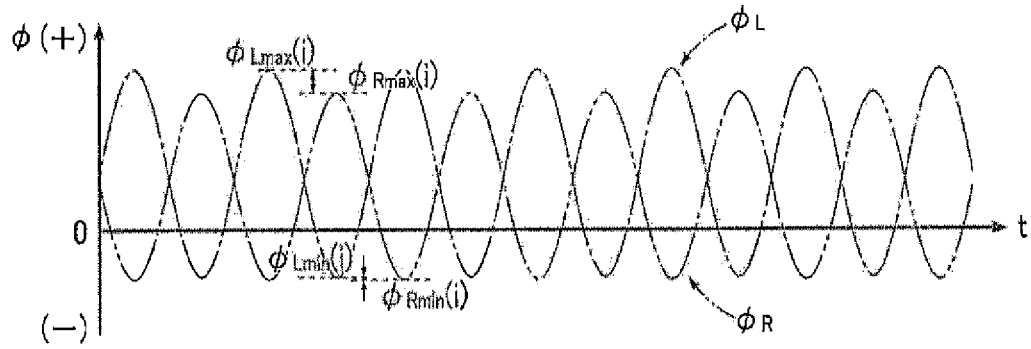

Accordingly, for example, the variation patterns of the right and left hip joint angles $\Phi L$ and $\Phi R$ as illustrated in FIG. 6(*a*), FIG. 6(*b*) or FIG. 6(*c*) are detected. FIG. 6(*a*), FIG. 6(*b*) and FIG. 6(*c*) illustrate the periodic variation patterns of the hip joint angles $\Phi L$ and $\Phi R$ in gait forms of a left circumduction, a left alignment and an insufficient right stretch, respectively.

Subsequently, a second step is performed to evaluate the asymmetry degree of motion patterns of a pair of lower limbs as the foundation of the motion control of the actuator 14 according to the variation patterns of the values of the pair of posture variables.

Specifically, the deviation of a first left index value $\mathfrak{f}L+$ from a first right index value $\theta R+$ is calculated as a first left asymmetry degree, and the deviation of the first right index value $\theta R+$ from the first left index value $\theta L+$ is calculated as a first right asymmetry degree.

Here, the first right index value $\theta R+$ denotes the maximum value $\Phi Rmax(k)$ of the right hip joint angles $\Phi R$ in the recent one walking cycle when a series of procedures are performed every one walking cycle, or the average value $\Sigma\Phi Rmax(i)/n$ of the maximum values $\Phi Rmax(i)$ in the recent n walking cycles (from (k−n+1)th to kth walking cycle) when the series of procedures are performed in n walking cycles. Similarly, the first left index value $\theta L+$ denotes a maximum value $\Phi Lmax(k)$ of the left hip joint angles $\Phi L$ in the recent one walking cycle (kth walking cycle), or the average value $\Sigma\Phi Lmax(i)/n$ of the maximum values $\Phi Lmax(i)$ in the recent n walking cycles.

Similarly, the deviation of a second left index value $\theta L-$ from a second right index value $\theta R-$ is calculated as a second left asymmetry degree, and the deviation of the second right index value θR+ from the second left index value θL− is calculated as a second right asymmetry degree.

Here, the left leg stretch index value θL− denotes the minimum value ΦLmin(k) of the left hip joint angles ΦL in the recent one walking cycle when the series of procedures are performed every one walking cycle, or the average value ΣΦLmin(i)/n of the minimum values ΦLmin(i) in the recent n walking cycles when the series of procedures are performed in n walking cycles. Similarly, the right leg stretch index value θR− denotes a minimum value ΦRmin(k) of the right hip joint angles ΦR in the recent one walking cycle, or the average value ΣΦRmin(i)/n of the minimum values ΦRmin(i) in the recent n walking cycles.

Thereafter, the sufficiency of a first left symmetry condition, namely whether the first left asymmetry degree (θL+−θR+) is equal to or smaller than a first threshold value θ1 (>0), is determined (FIG. 4/STEP 021).

If it is determined that the first left symmetry condition is not satisfied (FIG. 4/STEP 021 . . . NO), the first right asymmetry flag FR+ is set to "1" (FIG. 4/STEP 022). Whereupon, the sufficiency of a first right symmetry condition, namely whether the first right asymmetry degree (θR+-θL+) is equal to or smaller than the first threshold value θ1, is determined (FIG. 4/STEP 023). On the other hand, if it is determined that the first left symmetry condition is satisfied (FIG. 4/STEP 021 . . . YES), the sufficiency of the first right symmetry condition is determined directly (FIG. 4/STEP 023).

If it is determined that the first right symmetry condition is not satisfied (FIG. 4/STEP 023 . . . NO), the first left asymmetry flag FL+ is set to "1" (FIG. 4/STEP 024). Whereupon, the sufficiency of a second left symmetry condition, namely whether the second left asymmetry degree (θL−−θR−) is equal to or smaller than a second threshold value θ2 (0<θ2<θ1), is determined (FIG. 4/STEP 025). On the other hand, if it is determined that the first right symmetry condition is satisfied (FIG. 4/STEP 023 YES), the sufficiency of the second left symmetry condition is determined directly (FIG. 4/STEP 025).

If it is determined that the second left symmetry condition is not satisfied (FIG. 4/STEP 025 . . . NO), the second right asymmetry flag FR− is set to "1" (FIG. 4/STEP 026). Whereupon, the sufficiency of a second right symmetry condition, namely whether the second right asymmetry degree (θR−−θL−) is equal to or smaller than the second threshold value θ2, is determined (FIG. 4/STEP 027). On the other hand, if it is determined that the second left symmetry condition is satisfied (FIG. 4/STEP 025 . . . YES), the sufficiency of the second right symmetry condition is determined directly (FIG. 4/STEP 027).

If it is determined that the second right symmetry condition is not satisfied (FIG. 4/STEP 027 . . . NO), the second left asymmetry flag FL− is set to "1" (FIG. 4/STEP 028). On the other hand, if it is determined that the second right symmetry condition is satisfied (FIG. 4/STEP 027 . . . YES), the second left asymmetry flag FL− is maintained at "0".

Thereafter, on the basis of the evaluation results of the asymmetry degree, a third step for determining the gait form of a human being is performed. The gait form is broadly divided into two categories of strong asymmetry and weak asymmetry. Strong asymmetry category is further classified into 4 gait forms of right circumduction and left circumduction pertinent to a first gait form, and right alignment and left alignment pertinent to a second gait form. Weak asymmetry category is further classified into 4 gait forms of insufficient right flexion, insufficient left flexion, insufficient right stretch and insufficient left stretch pertinent to a third gait form.

Figure 7:
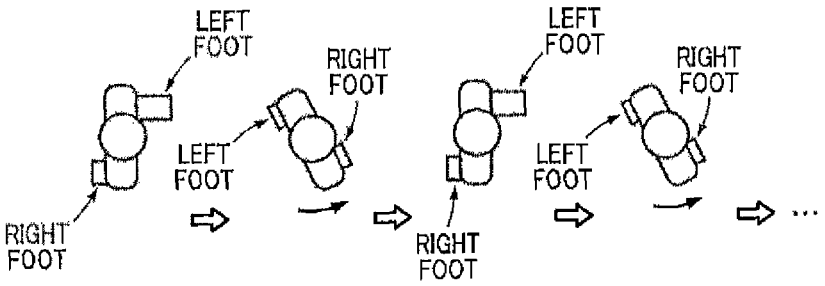
FIG. 7 is an explanatory diagram related to the classification of gait forms.
Figure 7:
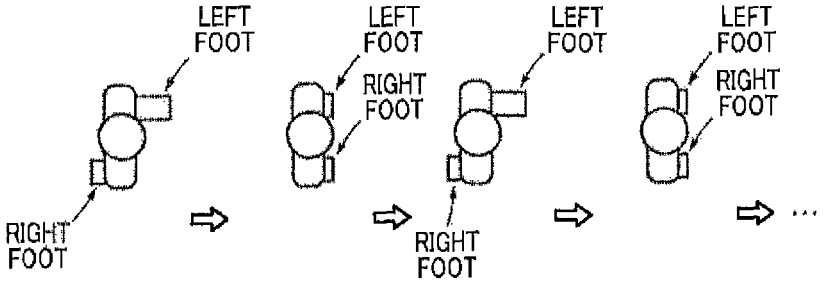
Figure 7:
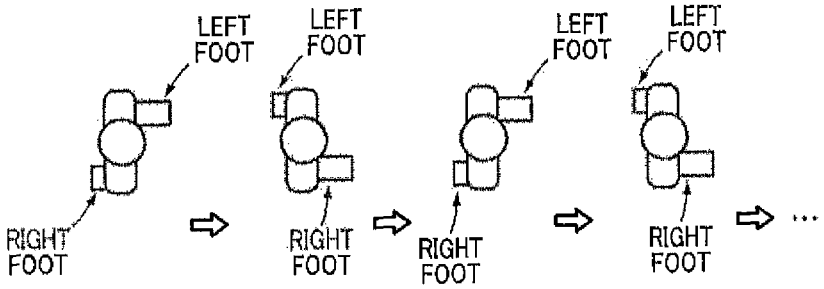

As illustrated in FIG. 7(*a*), the right circumduction refers to a gait form by which a human being advances by the movement of stepping the left foot forward and then gyrating the upper body counterclockwise viewed from above to move the right foot forward. Such gait form happens when a human being intentionally compensates the motor function of the right leg which is insufficient or decreased compared to the motor function of the left leg, for example.

In this case, the flexion amount (forward displacement amount) and the stretch amount (backward displacement amount) by the right leg are smaller than the flexion amount and the stretch amount by the left leg, respectively. Therefore, as illustrated in FIG. 6(*a*), the absolute value |ΦRmax| of the maximum value of the right hip joint angles ΦR is smaller than the maximum value |ΦLmax| of the maximum value of the left hip joint angles ΦR, and the absolute value |ΦRmin| of the minimum value of the right hip joint angles ΦR is smaller than the absolute value |ΦLmin| of the minimum value of the left hip joint angles ΦL.

Although not illustrated in the drawings, the left circumduction refers to a gait form by which a human being advances by the movement of stepping the right foot forward first and then gyrating the upper body clockwise viewed from above to move the left foot forward.

As illustrated in FIG. 7(*b*), the right alignment refers to a gait form by which a human being advances but pauses every step by stepping the left foot forward first and then stepping the right foot forward to align the right foot aside the left foot. Such gait form happens when a human being intentionally avoids supporting the entire body weight by the right leg due to the deteriorated motor function of the right leg or the like, for example.

In this case, the stretch amount by the right leg and the flexion amount by the left leg are smaller than normal, respectively. Therefore, as illustrated in FIG. 6(*b*), the maximum value ΦRmax of the right hip joint angles ΦR holds up at a degree slightly above zero and the minimum value ΦLmin of the left hip joint angles ΦL does not lead to negative.

Although not illustrated in the drawings, the left alignment refers to a gait form by which a human being advances but pauses every step by stepping the right foot forward first and then stepping the left foot forward to align the left foot aside the right foot.

As illustrated in FIG. 7(*c*), the weak right flexion refers to a gait form by which a human being advances by stepping the left foot and the right foot alternatively forward but with a relatively smaller flexion amount by the right leg and consequently a relatively smaller stepping amount by the right foot.

In this case, as illustrated in FIG. 6(*c*), the maximum value ΦRmax of the right hip joint angles ΦR is smaller than the maximum value ΦLmax of the left hip joint angles ΦL. In other words, the flexion amount by the right leg and the flexion amount by the left leg are asymmetrical with the degree of first right asymmetry degree (θR−−θL−) being greater than the second threshold value θ2.

The weak left flexion refers to a gait form by which a human being advances by stepping the left foot and the right foot alternatively forward but with a relatively smaller flexion amount by the left leg and consequently a relatively smaller stepping amount by the left foot. The weak right stretch refers to a gait form by which a human being advances by stepping the left foot and the right foot alternatively forward but with a relatively smaller stretch amount by the right leg and consequently a relatively smaller forward displacement amount by the upper body with the right foot landed. The weak left stretch refers to a gait form by which a human being advances by stepping the left foot and the right foot alternatively forward but with a relatively smaller stretch amount by the left leg and consequently a relatively smaller forward displacement amount by the upper body with the left foot landed.

Figure 5:
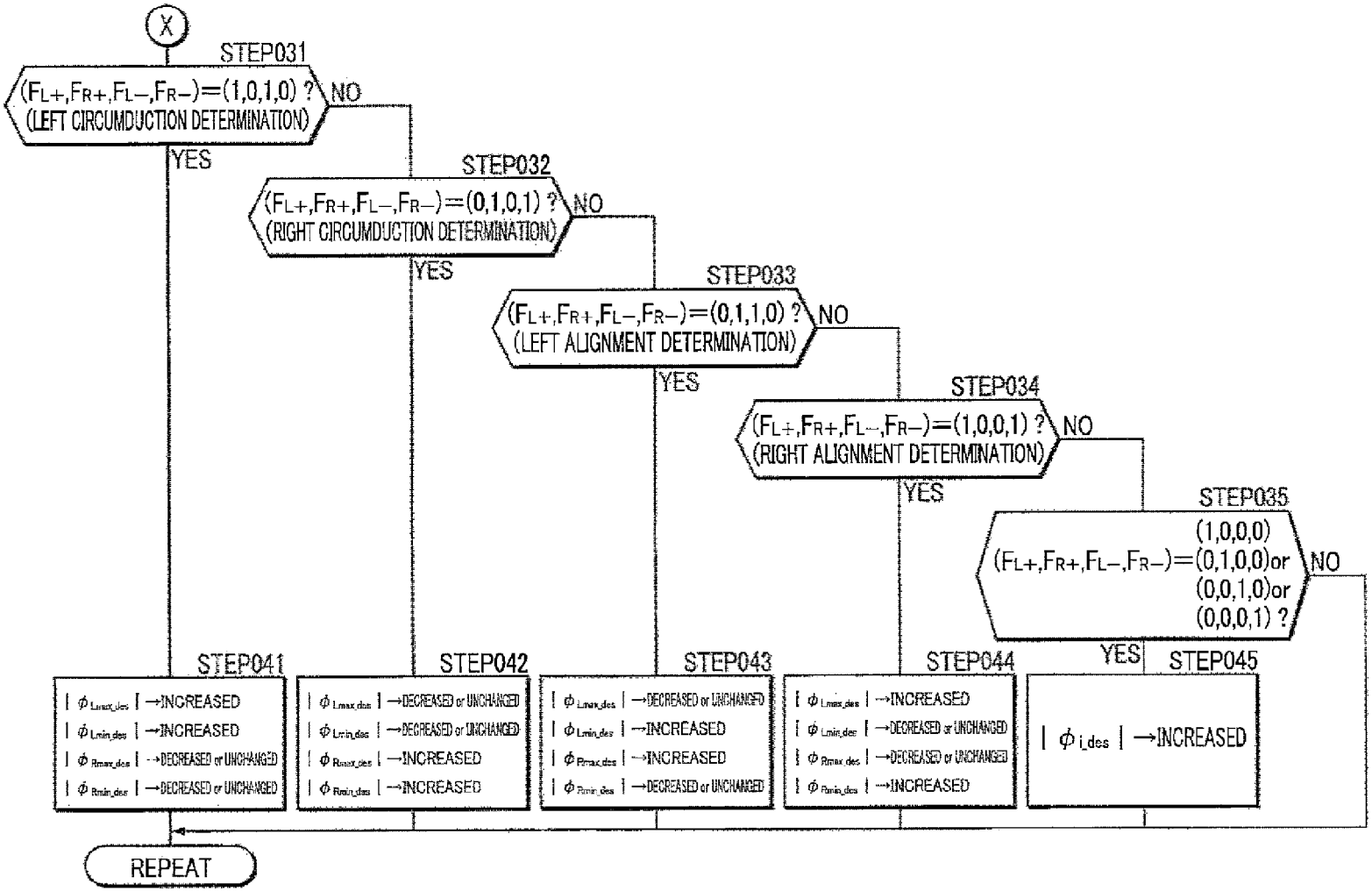
FIG. 5 is an explanatory diagram related to the control method and the rehabilitation method of the motion assisting device (Part 2)

Whether the gait form of the agent is of the left circumduction is determined according to whether or not the first left asymmetry flag FL+ and the second left asymmetry flag FL− are both "1" and meanwhile the first right asymmetry flag FR+ and the second right asymmetry flag FR− are both "0" (FIG. 5/STEP 031).

If it is determined that the gait form of the agent is not of the left circumduction (FIG. 5/STEP 031 . . . NO), whether the gait for is of the right circumduction is determined according to whether or not the first left asymmetry flag FL+ and the second left asymmetry flag FL− are both "0" and meanwhile the first right asymmetry flag FR+ and the second right asymmetry flag FR− are both "1" (FIG. 5/STEP 032).

If it is determined that the gait form of the agent is not of the right circumduction (FIG. 5/STEP 032 . . . NO), whether the gait form is of the left alignment is determined according to whether or not the first left asymmetry flag FL+ and the second right asymmetry flag FR− are both "0" and meanwhile the first right asymmetry flag FR+ and the second left asymmetry flag FL− are both "1" (FIG. 5/STEP 033).

If it is determined that the gait form of the agent is not of the left alignment (FIG. 5/STEP 033 . . . NO), whether the gait form is of the left alignment is determined according to whether or not the first left asymmetry flag FL+ and the second right asymmetry flag FR− are both "1" and meanwhile the first right asymmetry flag FR+ and the second left asymmetry flag FL− are both "0" (FIG. 5/STEP 034).

If it is determined that the gait form of the agent is not of the right alignment (FIG. 5/STEP 034 . . . NO), whether the gait form is of the weak asymmetry category and further which gait form in the weak asymmetry category is determined according to whether or not either one of the 4 asymmetry flags FL+, FR+, FL− and FR− is "1" (FIG. 5/STEP 035).

Then, a fourth step is performed to determine the motion pattern of the actuator 14 according to the gait form of the human being and control the motions of the actuator 14 according to the determined motion pattern. Specifically, a part of the desired maximum values Φmax_des and the desired minimum values Φmin_des of the right and left hip joint angles are corrected appropriately according to the gait form of the agent. Thereafter, as mentioned above, the motions of the actuator 14 is controlled by the controller 20 so as to match the maximum value Φmax and the minimum value Φmin of the posture variable Φ with the desired maximum value Φmax_des and the desired minimum value Φmin_des, respectively.

If it is determined that the gait form of the agent is of the left circumduction (FIG. 5/STEP 031 . . . YES), the desired maximum value ΦLmax_des and the desired minimum value ΦLmin_des of the left hip joint angles are corrected respectively to have the absolute value thereof increased, and meanwhile the desired maximum value ΦRmax_des and the desired minimum value ΦRmin_des of the right hip joint angles are maintained unchanged, or corrected to have the absolute value thereof decreased, respectively (FIG. 5/STEP 041).

An increment of the desired maximum value ΦLmax_des of the left hip joint angles may be adjusted according to an excess amount of the first left asymmetry degree (θL+−θR+) from the first threshold value θ1. An increment of the desired minimum value ΦLmin_des of the left hip joint angles may be adjusted according to an excess amount of the second left asymmetry degree (θL−−θR−) from the second threshold value θ2.

In the left circumduction, the walking motion of the agent is assisted by increasing at least the flexion amount and the stretch amount by the left leg of the agent so as to reduce or eliminate the flexion difference and the stretch difference between the right and the left legs of the agent. As a result, the gyrating amount by the upper body of the agent in the clockwise direction is reduced.

if it is determined that the gait form of the agent is of the right circumduction (FIG. 5/STEP 032 . . . YES), the desired maximum value Φmax_des and the desired minimum value ΦRmin_des of the right hip joint angles are corrected respectively to have the absolute value thereof increased, and meanwhile the desired maximum value ΦLmax_des and the desired minimum value ΦLmin_des of the left hip joint angles are maintained unchanged, or corrected to have the absolute value thereof decreased, respectively (FIG. 5/STEP 042).

An increment of the desired maximum value ΦRmax_des of the right hip joint angles may be adjusted according to an excess amount of the first right asymmetry degree (θR+−θL+) from the first threshold value θ1. An increment of the desired minimum value ΦRmin_des of the right hip joint angles may be adjusted according to an excess amount of the second right asymmetry degree (θR−−θL−) from the second threshold value θ2.

In the right circumduction, the walking motion of the agent is assisted by increasing at least the flexion amount and the stretch amount by the right leg of the agent so as to reduce or eliminate the flexion difference and the stretch difference between the right and the left legs of the agent. As a result, the gyrating amount by the upper body of the agent in the counterclockwise direction is reduced (refer to FIG. 7(*a*)).

If it is determined that the gait form of the agent is of the left alignment (FIG. 5/STEP 033 . . . YES), the desired minimum value ΦLmin_des of the left hip joint angles and the desired maximum value ΦRmax_des of the right hip joint angles are corrected respectively to have the absolute value thereof increased, and meanwhile the desired maximum value ΦLmax_des of the left hip joint angles and the desired minimum value ΦRmin_des of the right hip joint angles are maintained unchanged, or corrected to have the absolute value thereof decreased, respectively (FIG. 5/STEP 043).

In the left alignment, the walking motion of the agent is assisted by increasing at least the flexion amount by the right leg and the stretch amount by the left leg of the agent so as to reduce or eliminate the flexion difference and the stretch difference between the right and the left legs of the agent. As a result, the agent can translate the upper body thereof forward sufficiently while stepping the right foot forward sufficiently with the left foot landed (refer to FIG. 7(*b*)).

If it is determined that the gait form of the agent is of the right alignment (FIG. 5/STEP 034 . . . YES), the desired maximum value ΦLmax_des of the left hip joint angles and the desired minimum value ΦRmin_des of the right hip joint angles are corrected respectively to have the absolute value thereof increased, and meanwhile the desired minimum value ΦLmin_des of the left hip joint angles and the desired maximum value ΦRmax_des of the right hip joint angles are maintained unchanged, or corrected to have the absolute value thereof decreased, respectively (FIG. 5/STEP 044).

In the right alignment, the walking motion of the agent is assisted by increasing at least the flexion amount by the left leg and the stretch amount by the right leg of the agent so as to reduce or eliminate the flexion difference and the stretch difference between the right and the left legs of the agent. As a result, the agent can translate the upper body thereof forward sufficiently while stepping the left foot forward sufficiently with the right foot landed.

If it is determined that the gait form of the agent is of the insufficient right flexion, the insufficient left flexion, the insufficient right stretch or the insufficient left stretch (FIG. 5/STEP 035 . . . YES), only the desired maximum value ΦRmax_des of the right hip joint angles, the desired maximum value ΦLmax_des of the left hip joint angles, the desired minimum value ΦLmin_des of the right hip joint angles and the desired minimum value ΦLmin_des of the left hip joint angles is corrected to have the absolute value thereof increased, and meanwhile the other desired values are maintained unchanged, or corrected to have the absolute value thereof decreased, respectively (FIG. 5/STEP 045).

In this case, the walking motion of the agent is assisted by either one of at least the stretch amount and the flexion amount by the left leg and the stretch amount and the flexion amount by the right leg of the agent so as to reduce or eliminate the flexion difference and the stretch difference between the right and the left legs of the agent.

Other Embodiments of the Present Invention

In the above embodiment, the motions of a pair of lower limbs (legs) with respect to the upper body are assisted; however, as another embodiment, it is acceptable that the motions of a pair of upper limbs (arms) with respect to the upper body are assisted alternatively or additionally. In this case, the first orthosis is mounted on an upper dorsal portion of the upper body (near the shoulder blade or the like), and a pair of second orthoses are mounted on a pair of arms (the upper arms), respectively. The disposition of the actuator and the shape of the link member may be designed appropriately in consideration of assisting the swinging motions of the arms in the anteroposterior direction. Shoulder joint angles denoting the arm swing angles in the anteroposterior direction may be determined as the posture variables of the arms. The shoulder joint angles may be determined positive and negative with reference to the frontal plane, similar to the hip joint angles.

Moreover, it is acceptable to assist the stretch and flexion motions of a pair of legs about a pair of knee joints, respectively. In this case, the pair of first orthoses is mounted on the pair of thighs, respectively, and the pair of second orthoses is mounted on the pair of crus, respectively. The disposition of the actuator and the shape of the link member may be designed appropriately in consideration of assisting the stretch and flexion motions about the knee joint. Knee joint angles may be measured as the posture variable of the legs.

Similar to assisting the stretch and flexion motions about the knee joint of the leg, it is also acceptable to assist the stretch and flexion motions about the elbow joint or the carpal joint of the arm.

In the above embodiment, the arithmetic processes from the first step to the fourth step are all performed by the controller 20; however, as another embodiment, it is acceptable that a part of the arithmetic processes from the first step to the fourth step, for example, the discrimination of a gait form of the agent (the third step) and the determination of the motion patterns of the motion assisting device 1 according to the gait form (the fourth step) are performed by a person occupied in rehabilitation such as a physical therapist or the like.

After the physical therapist has visually recognized the asymmetry degree of the agent which is evaluated by a computer and displayed on a display, it is possible for the physical therapist to determine a gait form according to a determination method of gait forms displayed on a display or written in a separate document. After the physical therapist has visually recognized the gait form which is determined by a computer and displayed on a display, it is possible for the physical therapist to determine a control pattern according to a determination method of control patterns displayed on a display or written in a separate document. The motion pattern of the motion assisting device 1 may be controlled via manual operations on a switch, a button or the like provided with the controller 20.

(A First Embodiment of Motion Control According to the Hip Joint Angle Φ)

It is acceptable that the controller 20 is configured to control the motions of the actuator 14 so as to decrease the asymmetry degree and consequently the amplitude difference between the right and left hip joint angles according to a flexion state, a stretch state or an upswing state discriminated according to the hip joint angle Φ.

The flexion state refers to such a state that the hip joint angle Φ is increasing in a range smaller than a positive reference value Φc which is smaller than the desired maximum value Φmax_des. The stretch state refers to such a state that the hip joint angle Φ is decreasing. The upswing state refers to such a state that the hip joint angle Φ is increasing in a range not smaller than the positive reference value Φe.

Specifically, when a difference is present between motor function levels of a pair of legs of a human being due to the reason such as paralysis or the like, the controller 20 controls the motions of the actuator 14 to increase or decrease the assisting force as illustrated by Table 1 in comparison with the case where the difference is absent. In other words, the output from the actuator 14 is adjusted to increase (+) the assisting force F for the leg having a higher motor function level in the stretch state and decrease (−) it in the flexion state and the upswing state with reference to a reference assisting force Fc. On the other hand, the output from the actuator 14 is adjusted to decrease (−) the assisting force F for the leg having a lower motor function level in the stretch state and increase (+) it in the flexion state and the upswing state with reference to the reference assisting force Fc.

TABLE 1

| leg having a higher motor function level | | | leg having a lower motor function level | | |
|---|---|---|---|---|---|
| Flexion (1) | Stretch (2) | Upswing (3) | Flexion (4) | Stretch (5) | Upswing (6) |
| + | − | − | − | + | + |

Figure 8:
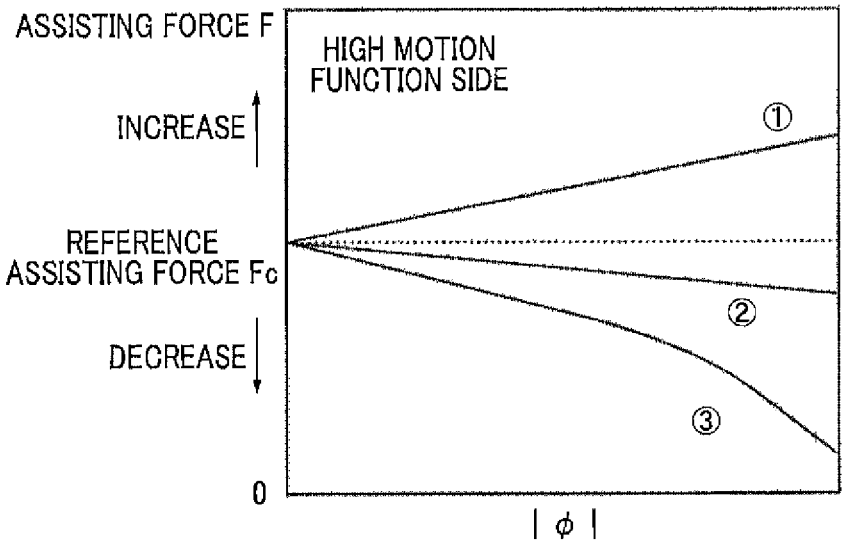
FIG. 8 is an explanatory diagram related to an adjusting method of an assisting force.
Figure 8:
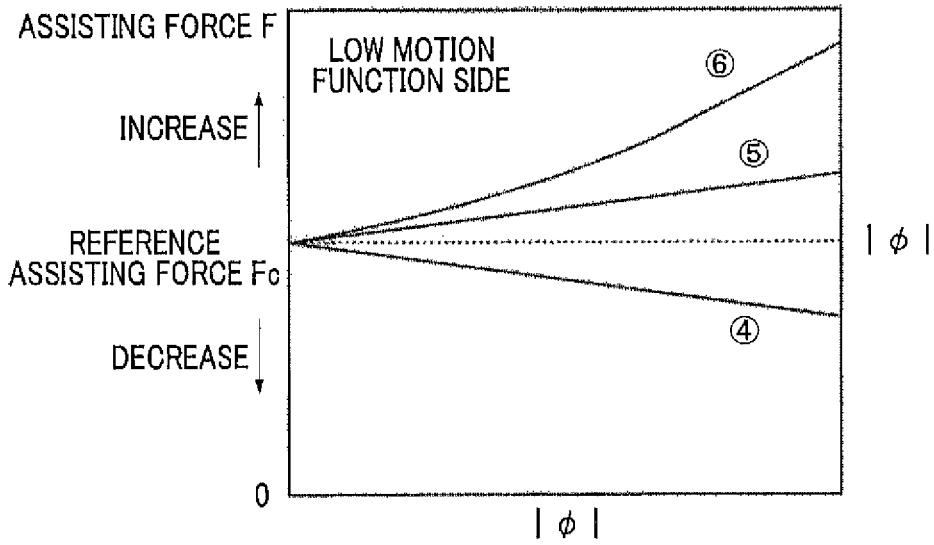

The assisting force is adjusted according to a map, a table or a relational expression denoting the relationship between the hip joint angle Φ of the agent and the assisting force F. Curved lines denoting such relationship are illustrated in FIG. 8. The reference assisting force Fc varies according to the hip joint angle Φ. In FIG. 8, the reference assisting force Fc is normalized and denoted by a dashed line. The curved lines numbered from 1 to 6 in FIG. 8 correspond to the numerals 1 to 6 in Table 1.

It is obvious from FIGS. 8(*a*) and 8(*b*) that a variation amount of the assisting force F from the reference assisting force Fc increases as the absolute value |Φ| of the hip joint angle increases. The increasing rate of the assisting force F with reference to the reference assisting force Fc becomes greater in the sequence of (5) where the leg having a lower motor function level in the stretch state, then (1) where the leg having a higher motor function level in the flexion state and then (6) where the leg having a lower motor function level in the upswing state. Meanwhile, the decreasing rate of the assisting force F with reference to the reference assisting force Fc increases in the sequence of (2) where the leg having a higher motor function level in the stretch state, then (4) where the leg having a lower motor function level in the flexion state and then (3) where the leg having a lower motor function level in the upswing state.

(A Second Embodiment of Motion Control According to the Hip Joint Angle Φ)

When a difference is present between motor function levels of a pair of legs of a human being, the controller 20 controls the motions of the actuator 14 to increase or decrease the assisting force F as illustrated by Table 2 in comparison with the case where the difference is absent. In other words, the output from the actuator 14 is adjusted to decrease (−) the assisting force F for the leg having a higher motor function level in the stretch state and the flexion state and increase (+) it in the upswing state with reference to the reference assisting force Fc. On the other hand, the output from the actuator 14 is adjusted to increase (+) the assisting force F for the leg having a lower motor function level in the stretch state and the flexion state and decrease (−) it in the upswing state with reference to the reference assisting force Fc.

TABLE 2

| leg having a higher motor function level | | | leg having a lower motor function level | | |
|---|---|---|---|---|---|
| Flexion (2) | Stretch (4) | Upswing (6) | Flexion (1) | Stretch (3) | Upswing (5) |
| − | − | + | + | + | − |

Figure 9:
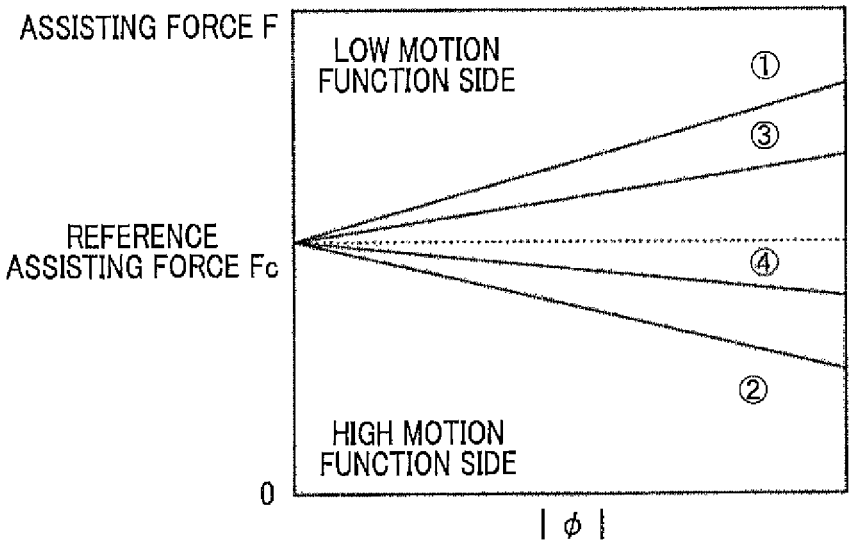
FIG. 9 is an explanatory diagram related to an adjusting method of an assisting force.
Figure 9:
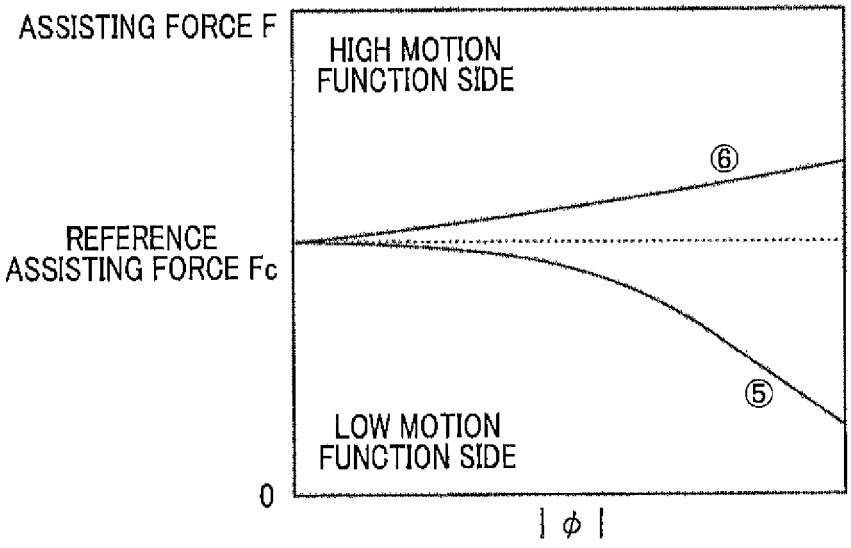

The assisting force is adjusted according to a map, a table or a relational expression denoting the relationship between the hip joint angle Φ of the agent and the assisting force F. Curved lines denoting such relationship are illustrated in FIG. 9. The reference assisting force Fc varies according to the hip joint angle Φ. In FIG. 9, the reference assisting force Fc is normalized and denoted by a dashed line. The curved lines numbered from 1 to 6 in FIG. 9 correspond to the numerals 1 to 6 in Table 2.

It is obvious from FIGS. 9(*a*) and 9(*b*) that the increasing rate of the assisting force F with reference to the reference assisting force Fc, with respect to the absolute value |Φ| of the hip joint angle becomes greater in the sequence of (6) where the leg having a higher motor function level in the upswing state, then (3) where the leg having a lower motor function level in the stretch state and then (1) where the leg having a lower motor function level in the flexion state. Meanwhile, the decreasing rate of the assisting force F with reference to the reference assisting force Fc, with respect to the absolute value |Φ| of the hip joint angle increases in the sequence of (4) where the leg having a higher motor function level in the stretch state, then (2) where the leg having a higher motor function level in the flexion state and then (5) where the leg having a lower motor function level in the upswing state in a range where the absolute value |Φ| is large (including the reference value Φc).

(Experimental Result)

Figure 10:
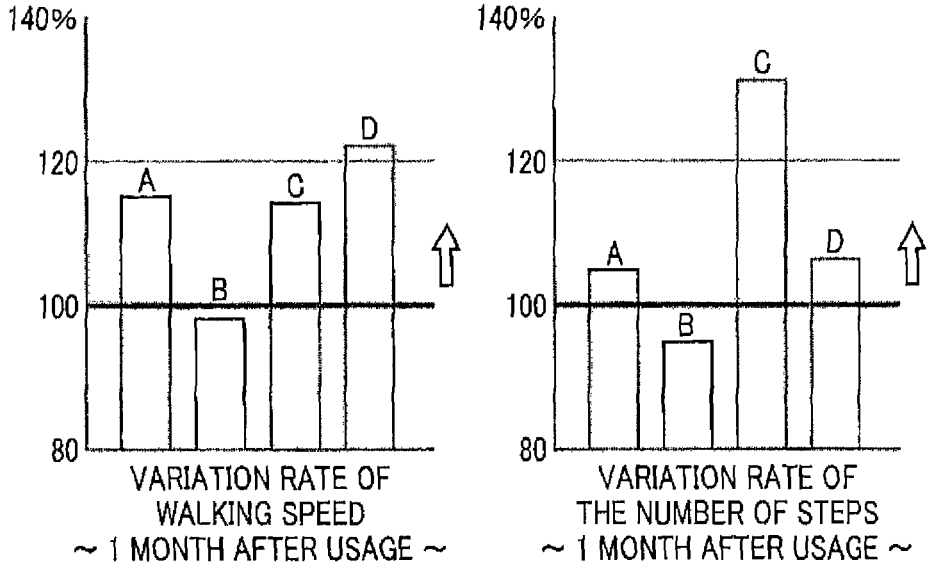
FIG. 10 is an explanatory diagram of an experiment result related to a walking speed and the number of steps.

FIG. 10 illustrates the variation rate of walking speed and the variation rate of the number of steps after the walk assisting device 1 has been applied to 4 agents of A to D for 1 month with reference to the case where the walk assisting device 1 was not applied. The maximum walking distance was limited to 10 m.

It is understood from FIG. 10 that the walking speed and the number of steps have been improved, and consequently the unbalance of the motor functions between the pair of legs has been corrected after the usage of the walk assisting device 1 for all the other agents except the agent B.

Figure 11:
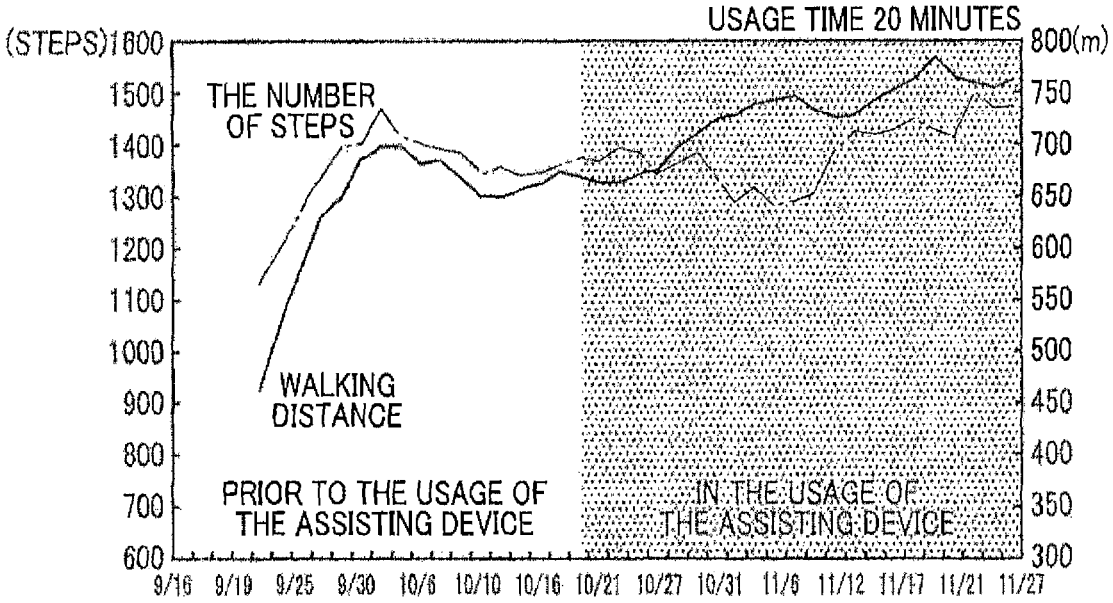
FIG. 11 is an explanatory diagram of an experiment result related to a walking distance and the number of steps.

FIG. 11 illustrates the variations on the walking distance and the number of steps of an agent before and after the usage of the motion assisting device 1. It is understood from FIG. 11 that the ratio of the walking distance to the number of steps, namely the average length of stride has been improved, and consequently the unbalance of the motor functions between the pair of legs has been corrected after the usage of the motion assisting device 1.

What is claimed is:

1. A control method for a motion assisting device provided with a pair of orthoses adapted to be mounted symmetrically on a pair of predetermined portions of a pair of limbs of a human being, respectively, and an actuator connected to each of the pair of orthoses, respectively, the control method being configured to control a variation pattern of an assisting force transmitted from the actuator to the pair of limbs via the pair of orthoses, respectively, and comprising:

a first step of detecting variation patterns of values of a pair of posture variables for a certain period of time varying periodically with postures of the pair of predetermined portions, respectively, wherein the pair of posture variables are relative angles of the predetermined portions relative to a predetermined part of a torso of said human being to which a basal end of said predetermined portions is attached, and a second step of evaluating an asymmetry degree of motion patterns of the pair of limbs as a foundation of motion control of the actuator according to the variation patterns of the values of the pair of posture variables for the certain period of time, wherein at least one of a deviation between maximum values and a deviation between minimum values of each of the pair of posture variables for the certain period of time is calculated as the asymmetry degree based on the variation patterns of the values of the pair of posture variables, or the asymmetry degree is evaluated to become continuously or gradually higher as the deviation becomes greater based on the variation patterns of the values of the pair of posture variables in the second step.

2. The control method for the motion assisting device according to claim 1, further comprising a third step of discriminating a gait form of the human being according to an evaluation result of the asymmetry degree.

3. The control method for the motion assisting device according to claim 2, wherein a first left asymmetry degree which is a deviation of a maximum value or an average value of the posture variables of the left limb from a maximum value or an average value of the posture variables of the right limb, a first right asymmetry degree which is a deviation of a maximum value or an average value of the posture variables of the right limb from a maximum value or an average value of the posture variables of the left limb, a second left asymmetry degree which is a deviation of a minimum value or an average value of the posture variables of the left limb from a minimum value or an average value of the posture variables of the right limb, and a second right asymmetry degree which is a deviation of a minimum value or an average value of the posture variables of the right limb from a minimum value or an average value of the posture variables of the left limb are calculated as the asymmetry degree in the second step, and the third step comprising determining whether a first right symmetry condition that the first right asymmetry degree is not greater than a first predetermined value is satisfied, determining whether a first left symmetry condition that the first left asymmetry degree is not greater than the first predetermined value is satisfied, determining whether a second right symmetry condition that the second right asymmetry degree is not greater than a second predetermined value is satisfied, and determining whether a second left symmetry condition that the second left asymmetry degree is not greater than the second predetermined value is satisfied, and the gait form of the human being is discriminated according to different determination results.

4. The control method for the motion assisting device according to claim 3, wherein the gait form of the human being is discriminated as a specific gait form in the third step if a determination result is that the first left symmetry condition and the second left symmetry condition among the first right, first left, second right, and second left symmetry conditions are not satisfied or the first right symmetry condition and the second right symmetry condition among the first right, first left, second right, and second left symmetry conditions are not satisfied.

5. The control method for the motion assisting device according to claim 3, wherein the gait form of the human being is discriminated as a specific gait form in the third step if a determination result is that the first left symmetry condition and the second right symmetry condition among the first right, first left, second right, and second left symmetry conditions are not satisfied or the first right symmetry condition and the second left symmetry condition among the first right, first left, second right, and second left symmetry conditions are not satisfied.

6. The control method for the motion assisting device according to claim 3, wherein the gait form of the human being is discriminated as a specific gait form in the third step if a determination result is that any one symmetry condition among the first right, first left, second right, and second left symmetry conditions is not satisfied.

7. The control method for the motion assisting device according to claim 3, further comprising a fourth step of controlling motions of the actuator so as to make the first right, first left, second right, and second left symmetry conditions satisfied respectively.

8. The control method for the motion assisting device according to claim 1, wherein a temporal variation pattern of inclined angles by a joint, which is located at a root of each of the pair of limbs to a main body, in an anteroposterior direction is detected as a temporal variation pattern of the values of the posture variables in the first step.

9. A motion assisting device provided with a pair of orthoses adapted to be mounted symmetrically on a pair of predetermined portions of a pair of limbs of a human being, respectively, an actuator connected to each of the pair of orthoses, respectively, and a controller being configured to control a variation pattern of an assisting force transmitted from the actuator to the pair of limbs via the pair of orthoses, respectively, through controlling motions of the actuator, wherein the controller is configured to detect variation patterns of values of a pair of posture variables for a certain period of time varying periodically with postures of the pair of predetermined portions, respectively, wherein the pair of posture variables are relative angles of the predetermined portions relative to a predetermined part of a torso of said human being to which a basal end of said predetermined portions is attached, and evaluate an asymmetry degree of motion patterns of the pair of limbs as a foundation of a motion control of the actuator according to the variation patterns of the values of the pair of posture variables for the certain period of time, wherein at least one of a deviation between maximum values and a deviation between minimum values of each of the pair of posture variables for the certain period of time is calculated as the asymmetry degree based on the variation patterns of the values of the pair of posture variables, or the asymmetry degree is evaluated to become continuously or gradually higher as the deviation becomes greater based on the variation patterns of the values of the pair of posture variables in the second step.

10. The motion assisting device according to claim 9, wherein the motion assisting device is a walk assisting device configured to assist periodic motions of a thigh in each of a pair of legs serving as the pair of limbs in a walking motion of the human being, and the controller is configured to control the motions of the actuator to decrease the asymmetry degree.

11. A rehabilitation method for rehabilitating motor functions of a pair of limbs of a human being by using a motion assisting device provided with a pair of orthoses adapted to be mounted symmetrically on a pair of predetermined portions of the pair of limbs of the human being, respectively, an actuator connected to each of the pair of orthoses, respectively, and a controller being configured to control a variation pattern of an assisting force transmitted from the actuator to the pair of limbs via the pair of orthoses, respectively, through controlling motions of the actuator, the rehabilitation method comprising:

a first step of detecting variation patterns of values of a pair of posture variables for a certain period of time varying periodically with postures of the pair of predetermined portions, respectively, wherein the pair of posture variables are relative angles of the predetermined portions relative to a predetermined part of a torso of said human being to which a basal end of said predetermined portions is attached, a second step of evaluating an asymmetry degree of motion patterns of the pair of limbs as a foundation of a motion control of the actuator according to the variation patterns of the values of the pair of posture variables for the certain period of time, a third step of discriminating a gait form of the human being according to an evaluation result of the asymmetry degree, and a fourth step of determining a control pattern of the motions of the actuator according to the gait form of the human being, wherein at least one of a deviation between maximum values and a deviation between minimum values of each of the pair of posture variables for the certain period of time is calculated as the asymmetry degree based on the variation patterns of the values of the pair of posture variables, or the asymmetry degree is evaluated to become continuously or gradually higher as the deviation becomes greater based on the variation patterns of the values of the pair of posture variables in the second step.

* * * * *